US011446837B2

(12) United States Patent
Lee et al.

(10) Patent No.: US 11,446,837 B2
(45) Date of Patent: Sep. 20, 2022

(54) RAZOR

(71) Applicant: DORCO CO., LTD., Seoul (KR)

(72) Inventors: Young Jin Lee, Seoul (KR); Da Woon Han, Seoul (KR); Jong Jin Jeong, Seoul (KR)

(73) Assignee: DORCO CO., LTD., Seoul (KR)

( * ) Notice: Subject to any disclaimer, the term of this patent is extended or adjusted under 35 U.S.C. 154(b) by 0 days.

(21) Appl. No.: 17/109,065

(22) Filed: Dec. 1, 2020

(65) Prior Publication Data

US 2021/0187768 A1 Jun. 24, 2021

(30) Foreign Application Priority Data

Dec. 18, 2019 (KR) ..... 10-2019-0170123

(51) Int. Cl.
*B26B 21/52* (2006.01)
*B26B 21/22* (2006.01)

(52) U.S. Cl.
CPC ..... *B26B 21/521* (2013.01); *B26B 21/225* (2013.01)

(58) Field of Classification Search
None
See application file for complete search history.

(56) References Cited

U.S. PATENT DOCUMENTS 4,599,793 A * 7/1986 Iten ..... B26B 21/225 30/47
5,584,105 A * 12/1996 Krauss ..... A44B 11/263 24/614
5,687,485 A 11/1997 Shurtleff et al.
5,761,814 A 6/1998 Anderson et al.
5,956,848 A 9/1999 Tseng et al.
5,956,851 A 9/1999 Apprille et al.
6,041,926 A 3/2000 Petricca et al.
(Continued)

FOREIGN PATENT DOCUMENTS

CA 2928818 11/2017
EP 3461604 4/2019
(Continued)

OTHER PUBLICATIONS

European Patent Office Application Serial No. 20212139.8, Partial European Search Report dated May 21, 2021, 11 pages.

*Primary Examiner* — Hwei-Siu C Payer
(74) *Attorney, Agent, or Firm* — Lee, Hong, Degerman, Kang & Waimey PC

(57) ABSTRACT

A razor includes a razor cartridge including at least one shaving blade, a handle having an internal space, and a head unit. The head unit includes a cartridge-engaging segment configured to be coupled to the razor cartridge, and a handle-engaging segment having at least a portion configured to be inserted into the internal space and including a first cantilever section that is configured: to be inserted into the internal space by contacting at least a portion of an inner circumferential surface of the internal space, and to be at least partially elastically deformable such that a diameter of the first cantilever section along a length of the first cantilever section decreases toward a free end of the first cantilever section contacting the inner circumferential surface initially and being squeezed toward a longitudinal central axis of the handle-engaging segment when the first cantilever section is inserted into the internal space.

17 Claims, 6 Drawing Sheets

(56) References Cited

U.S. PATENT DOCUMENTS

| | | | | |
|---|---|---|---|---|
| 6,052,903 | A | 4/2000 | Metcalf et al. | |
| 6,185,822 | B1 | 2/2001 | Tseng et al. | |
| 6,212,777 | B1 | 4/2001 | Gilder et al. | |
| 6,317,990 | B1 | 11/2001 | Ferraro | |
| 6,442,839 | B1 | 9/2002 | Tseng et al. | |
| 6,516,518 | B1 | 2/2003 | Garraway et al. | |
| 6,612,040 | B2 | 9/2003 | Gilder | |
| 6,684,513 | B1 | 2/2004 | Clipstone et al. | |
| 8,096,054 | B2 * | 1/2012 | Denkert | B26B 21/225 30/50 |
| 9,259,846 | B1 | 2/2016 | Robertson | |
| 9,873,206 | B2 * | 1/2018 | Gulledge | B26B 21/521 |
| 11,007,661 | B2 * | 5/2021 | Mazarakis | B26B 21/521 |
| 2003/0188444 | A1 * | 10/2003 | Ferraro | B26B 21/22 30/526 |
| 2009/0100679 | A1 * | 4/2009 | Casciaro | B26B 21/165 30/34.05 |
| 2016/0250760 | A1 * | 9/2016 | Phoon | B26B 21/521 30/277.4 |
| 2017/0136638 | A1 * | 5/2017 | Hage | B26B 21/443 |
| 2021/0187768 | A1 * | 6/2021 | Lee | B26B 21/225 |

FOREIGN PATENT DOCUMENTS

| | | |
|---|---|---|
| JP | 2006291554 | 10/2006 |
| KR | 200400540 | 11/2005 |
| WO | 2017024156 | 2/2017 |

* cited by examiner (a)

(b)

(c)

(a)

(b)

RAZOR

CROSS-REFERENCE TO RELATED APPLICATION

Pursuant to 35 U.S.C. § 119(a), this application claims the benefit of earlier filing date and right of priority to Korean Patent Application Number 10-2019-0170123, filed on Dec. 18, 2019, the contents of which are incorporated by reference herein in its entirety.

TECHNICAL FIELD

The present disclosure relates to a razor.

BACKGROUND

The statements in this section merely provide background information related to the present disclosure and do not necessarily constitute prior art.

The recent emergence of the seriousness of environmental destruction has driven the respective countries and various international organizations to establish measures related to environmental regulations. For example, Canada and the European Union have passed legislation banning the use of single-use plastics or imposing their reduction obligation from the year 2021. In response, manufacturers of various disposable products are replacing at least some of the disposable products with eco-friendly materials.

Under this trend, a disposable razor has been disclosed as in Korean Patent No. 10-1612431, which is composed of an eco-friendly material with the handle being formed integral with the head unit. However, since the disposable razor has its handle and head unit incapable of being recoupled once they are separated, the handle is bound to accompany the head unit to waste as soon as the latter needs a replacement of the shaving blade, which adds unneeded amount to the mass of garbage.

To solve this issue, an eco-friendly razor is being developed to have a long-lasting reusable handle with just a head unit designed to be replaceable. The handle portion of the eco-friendly razor can be made of an eco-friendly material such as a biodegradable material, for example, wood or paper. Since wood or paper has a difficult material property to take injection molding, there is a technical difficulty with utilizing the material in manufacturing a product to have features such as grooves of a certain requirements. Therefore, the eco-friendly handle is generally manufactured in a simple hollow column shape devoid of a separate fastening structure.

These factors add to the difficulty in easily assembling or disassembling the head unit and handle of the razor by the user.

Furthermore, the lack of a fastening structure provides insufficient fixing force, which lets the handle jolt in a shaving stroke.

SUMMARY

According to at least one embodiment, the present disclosure provides a razor including a razor cartridge including at least one shaving blade, a handle having an internal space, and a head unit. The head unit includes a cartridge-engaging segment configured to be coupled to the razor cartridge, and a handle-engaging segment having at least a portion configured to be inserted into the internal space of the handle and including a first cantilever section. The first cantilever section is configured to be inserted into the internal space by contacting at least a portion of an inner circumferential surface of the internal space, and configured to be at least partially elastically deformable such that a diameter of the first cantilever section along a length of the first cantilever section decreases toward a free end of the first cantilever section contacting the inner circumferential surface initially and being squeezed toward a longitudinal central axis of the handle-engaging segment when the first cantilever section is inserted into the internal space.

DETAILED DESCRIPTION

Figure 1:
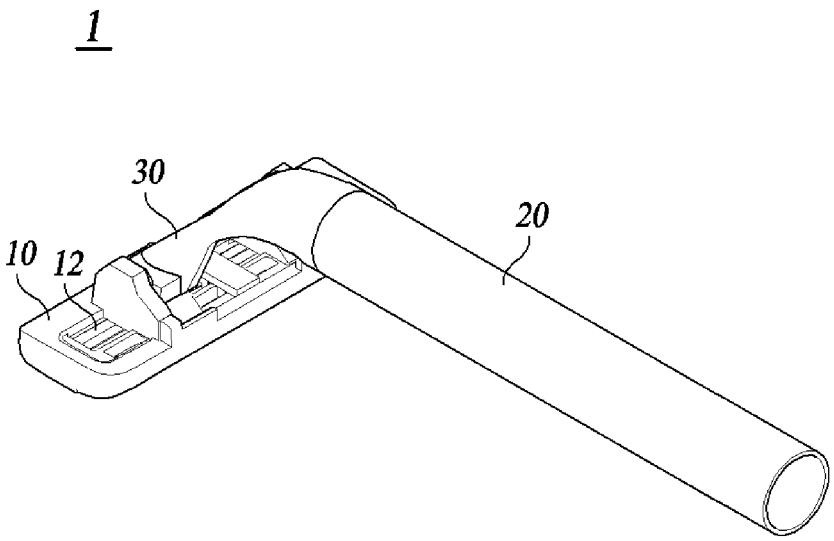
FIG. 1 is a perspective view of a razor according to at least one embodiment of the present disclosure.

Accordingly, the present disclosure in at least one embodiment seeks to provide a razor having a handle and a head unit that are easy to assemble.

Further, the present disclosure seeks to provide a razor with a stable shaving function without unnecessary shaking when a user strokes using the razor with the head unit at least partially inserted into an internal space of the handle.

The problems to be solved by the present disclosure are not limited to those mentioned above, and other unmentioned problems will be clearly understood by those skilled in the art from the following description.

Some exemplary embodiments of the present disclosure are described below with reference to the accompanying drawings. In the following description, like reference numerals preferably designate like elements, although the elements are shown in different drawings. Further, in the following description of some embodiments, a detailed description of known functions and configurations incorporated herein will be omitted for the purpose of clarity and for brevity.

Additionally, alphanumeric codes such as first, second, i), ii), (a), (b), etc., in numbering components are used solely for the purpose of differentiating one component from the other but not to imply or suggest the substances, the order or sequence of the components. Throughout this specification, when a part "includes" or "comprises" a component, the part is meant to further include other components, not excluding thereof unless there is a particular description contrary thereto.

The present disclosure has been described based on that a handle 20 and a handle-engaging segment 300 are configured to be circular in vertical section. However, the present disclosure is not limited thereto, and the vertical section may be configured to be polygonal among others.

In the present specification, 'upward' when the user strokes a razor 1 refers to a direction of a vertical component of a force that a razor cartridge 10 receives from a shaving object such as the user's face. 'Downward' refers to a direction of a vertical component of a force that the shaving object receives from the razor cartridge 10 when the user strokes the razor 1. 'Sideward' means a middle point between the upward and downward, for example a direction pointing to the left or right.

Figure 2:
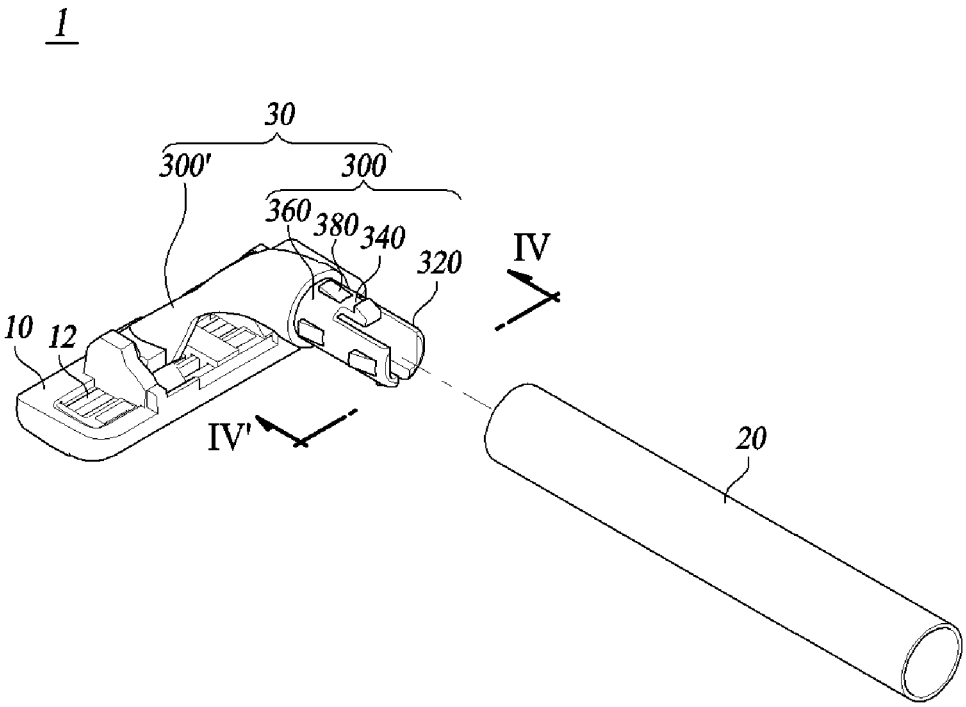
FIG. 2 is an exploded perspective view of the razor according to at least one embodiment of the present disclosure.

FIG. 1 is a perspective view of a razor according to at least one embodiment of the present disclosure. FIG. 2 is an exploded perspective view of the razor according to at least one embodiment of the present disclosure.

As shown in FIGS. 1 and 2, the razor 1 includes the razor cartridge 10, a handle 20, and a head unit 30.

The razor cartridge 10 includes at least one or more shaving blades 12. The razor cartridge 10 is a part that directly contacts the user's skin and shaves a beard or body hair.

The cartridge 10 and the head unit 30 may be pivotally coupled to each other. In this case, the cartridge 10 may pivot with respect to the head unit 30 along the user's skin surface during the stroke which can be performed by the cartridge 10 at an angle to be in close contact with the curvature of the skin surface. This relieves the user from having to manually adjust the angle of the handle 20 according to the stroke direction or the curvature of the skin surface. Then, the razor 1 will be more comfortable to use. However, the present disclosure is not limited to this specific configuration. Alternatively, the cartridge 10 and the head unit 30 may be configured to be firmly coupled to each other.

The handle 20 has an internal space therein. At least a part of the head unit 30 is inserted into the internal space. The handle 20 may be made of an eco-friendly material. For example, the handle 20 may be made of an eco-friendly material such as paper or wood, for example, bamboo.

The head unit 30 has one side including a cartridge-engaging segment 300' configured to be fastened with the razor cartridge 10 and the other side including a handle-engaging segment 300 configured to be fastened with the handle 20.

At least a portion of the handle-engaging segment 300 may be inserted into the internal space of the handle 20. The handle-engaging segment 300 and the handle 20 may be intercoupled in a force-fitting manner. In general, when the handle 20 and the handle-engaging segment 300 are forcibly fitted, the handle 20 corresponding to the female part is composed of an elastic material, while the handle-engaging segment 300 corresponding to the male part may be composed of an inelastic material. However, when the handle 20 is made of wood or paper as in the present embodiment, the elasticity of the handle 20 may not be sufficient to stably perform the force-fitting coupling. It is preferable that the handle-engaging segment 300 is configured to allow an appropriate degree of elastic deformation even with the inelasticity of the handle 20. For example, the handle-engaging segment 300 may be composed of synthetic resin. Composed of synthetic resin, the handle-engaging segment 300 becomes favorably easy to form by injection molding among other methods. However, the present disclosure is not so limited, and may select other materials having elasticity for the handle-engaging segment 300.

The handle-engaging segment 300 of the head unit 30 may be formed integrally with the cartridge-engaging segment 300', or they may be formed separately.

Figure 3:
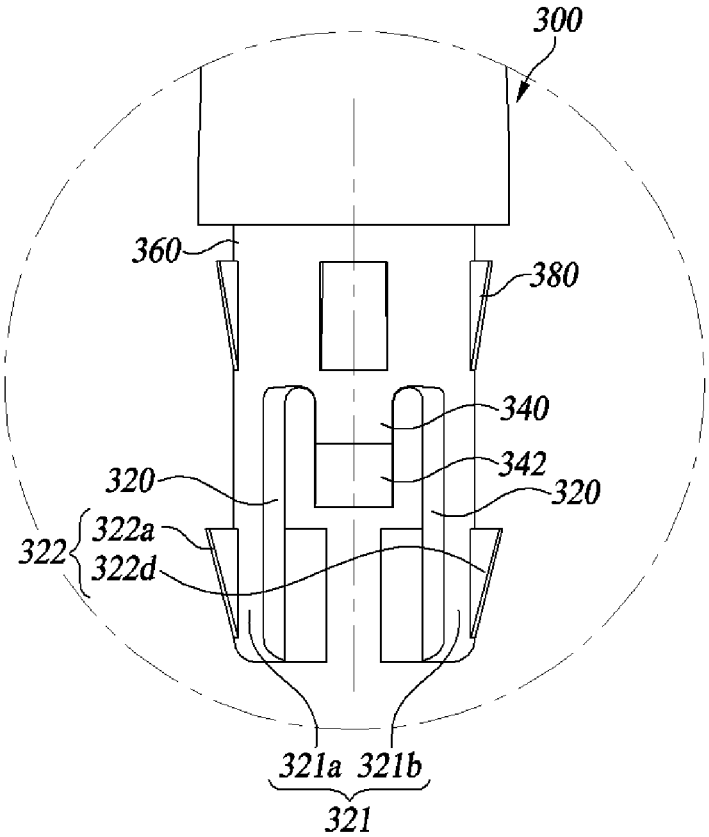
FIG. 3 is an enlarged view of a handle-engaging segment according to at least one embodiment of the present disclosure.

On the other hand, the handle-engaging segment 300 may include a first cantilever section 320 having one or more first locking projections 322*a*, 322*b*, 322*c*, 322*d* (or collectively 322 as shown in FIG. 3), one or more second cantilever sections 340 having a second locking projection 342 as shown in FIG. 3, a support 360 and one or more third locking protrusions 380.

The first cantilever sections 320 are each configured such that at least a portion thereof contacts the inner circumferential surface of the internal space formed inside the handle 20. The handle-engaging segment 300 is configured so that when inserted into the internal space of the handle 20, the first cantilever sections 320 may be at least partially elastically deformed. Further, the first cantilever section 320 may be configured to be at least partially reduced in outer diameter toward an insertion direction (direction toward which the handle-engaging segment 300 is inserted into the internal space of the handle 20.)

As described above, the handle 20 may be made of a material having insufficient elasticity, such as wood. In this case, the handle-engaging segment 300 may be configured to be elastically deformable in order to be force-fitted with such inelastic handle 20. The first cantilever section 320 has one end, namely, a free end that is configured to be elastically deformed. The handle-engaging segment 300 may be configured to be inserted into the handle 20 by the free end of the first cantilever section 320 being bent toward the central axis of the handle 20 and reduced in outer diameter toward the insertion direction of the handle-engaging segment 300.

Figure 4:
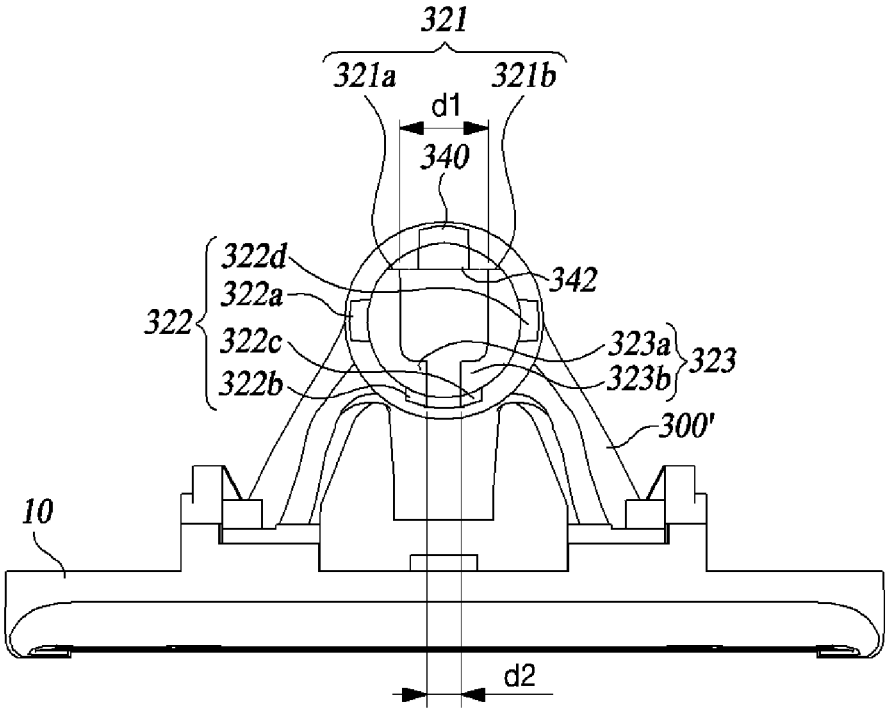
FIG. 4 is a front view of the razor of FIG. 2 as viewed from a direction IV-IV'.

The first cantilever section 320 may include a plurality of arms. Although FIG. 2 illustrates two arms, they are not necessarily limited to the two. The plurality of arms 321*a* and 321*b* as shown in FIG. 3 may be formed in a symmetrical shape with respect to a central axis of the handle 20. This can provide supporting forces that are the same in magnitude in the width direction of the handle 20 and are symmetrical in orientation. When the first cantilever section 320 includes a plurality of arms, a first gap d1 as shown in FIG. 4 is formed between neighboring arms.

The second cantilever section 340 may be disposed within the first gap d1 of the first cantilever section 320. The length of the second cantilever section 340 may have a length different from that of the first cantilever section 320, for example, it may be shorter or longer than the first cantilever section 320. This can provide a supporting force at a plurality of points along the longitudinal direction of the handle 20. In other words, there are at least two or more points of action along the longitudinal direction. This enhances the fastening force between the handle 20 and the handle-engaging segment 300, and the coupling between the razor cartridge 10 and the handle 20 can be firmly maintained during a stroke. Where only one point of action exists, it needs to take continuous frictional force and support force and thereby causes the handle 20 made of an eco-friendly material to be easily damaged. On the other hand, with at least two points of action provided along the longitudinal direction of the handle 20, an advantageous distribution of the points of action (force) can be provided. Accordingly, the handle 20 can be prevented from being damaged.

Figure 6:
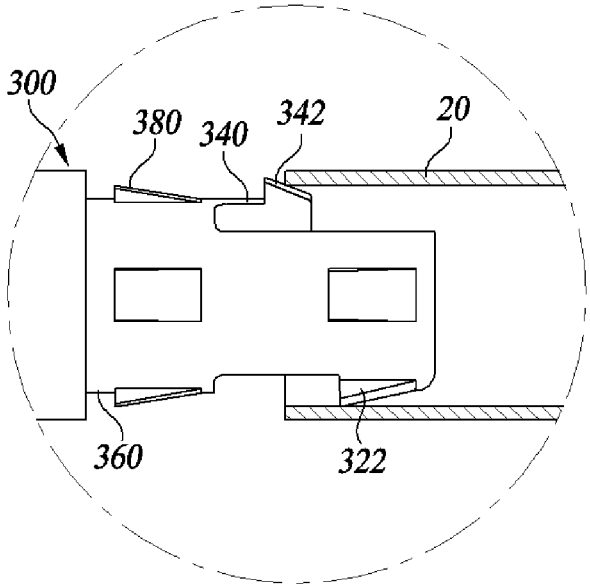
FIG. 6 illustrates sequential steps of the process of inserting the handle-engaging segment into the handle according to at least one embodiment of the present disclosure.
Figure 6:
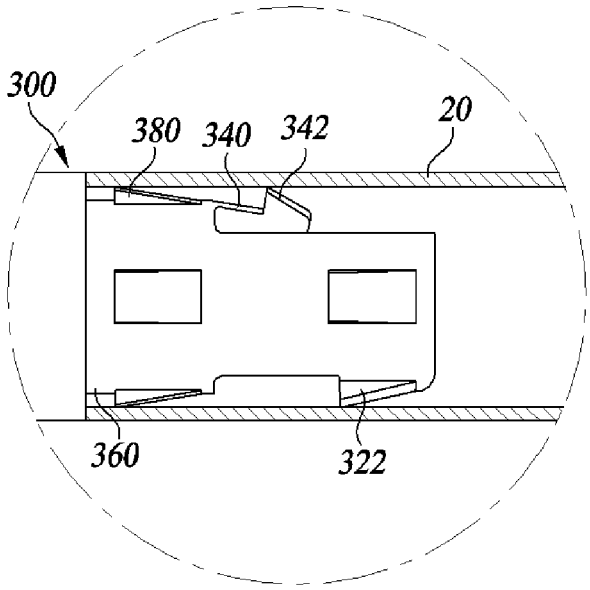

A configuration and function of the second cantilever section 340 will be detailed referring to FIG. 6.

The support 360 is formed in an approximately columnar shape to conform to the handle 20 and is disposed between the first cantilever section 320 and the cartridge-engaging segment 300' to support the respective cantilever sections 320 and 340. In the present disclosure, the handle 20 is shown to be configured in a cylindrical shape. However, the present disclosure is not so limited, and the cross sections of the handle 20 and the support 360 may be configured to be those of polygonal columns or other shapes.

The first cantilever section 320 and the second cantilever section 340 each has a free end and a fixed end. Hypothetically, the fixed ends of the first cantilever section 320 and the second cantilever section 340 might be directly attached to the cartridge-engaging segment 300'. Then, no separate fastening or supporting structure would be disposed between the fixed ends of the respective cantilever sections 320, 340 and the cartridge-engaging segment 300'. That will require the third locking projections 380 to be disposed right on the arms of the first cantilever section 320 and the second cantilever section 340. If that is the case, an insertion of the handle-engaging segment 300 into the internal space of the handle 20 will cause the arms of the first cantilever section 320 and the second cantilever section 340 to be bent radially inwardly of the handle 20 along the direction in which the arms are pressed. Therefore, the third locking projections 380 configured to prevent jolting of the handle 20 moves toward the direction in which the cantilever arms are bent, failing to sufficiently achieve the purpose and effect of the third locking projections 380.

To the contrary, when placed along the outer circumferential surface of the support 360 configured in a substantially columnar shape, the third locking projections 380 can stay put without swinging radially inwardly. This properly achieves the purpose and effect of the third locking projections 380.

Without the support 360 included in the handle-engaging segment 300, in case at least one of the cantilevers 320 and 340 is damaged or even cut away, the handle-engaging segment 300 and the handle 20 will lose a stable coupling therebetween. The support 360 that is now included in the handle-engaging segment 300 can serve to maintain a stable coupling between the handle-engaging segment 300 and the handle 20, even when at least one of the arms of the first cantilever section 320 and the second cantilever section 340 is damaged.

Further, the fixed ends of the respective cantilevers 320, 340 are formed extending from the support 360, which saves the respective cantilevers 320, 340 from the risk of being bent or broken even under an external force acting on the handle 20, for example, an external force acting radially inwardly of the handle 20.

The one or more third locking projections 380 may be disposed along the outer circumferential surface of the support 360. At this time, the one or more third locking projections 380 may be configured to at least partially contact the inner circumferential surface of internal space of the handle 20.

The third locking projection 380 may include an inclined surface configured to decrease in height in the insertion direction of the handle-engaging segment 300. So, the handle-engaging segment 300 is guided by the inclined surface of the third locking projection 380, when it is easily inserted into the internal space of the handle 20.

With the handle 20 and the handle-engaging segment 300 intercoupled, the one or more second locking projections 342 are spaced apart from the coupling end of the handle 20 by a predetermined distance or more. Further, the diameter of the support 360 is configured to be equal to or smaller than the inner diameter of the handle 20. Therefore, when the razor 1 is used, the handle 20 may swing up and down or in the left and right directions depending on the direction in which it is depressed. The third locking projections 380 may serve to prevent such rocking.

Multiple third locking projections 380 may be disposed at equal intervals along the outer circumferential surface of the support 360. This allows the handle 20 and the handle-engaging segment 300 to be more stably intercoupled.

FIG. 3 is an enlarged view of the handle-engaging segment according to at least one embodiment of the present disclosure. FIG. 4 is a front view of the razor of FIG. 2 as viewed from a direction IV-IV'.

As shown in FIGS. 3 and 4 together, the first cantilever section 320 includes a plurality of arms 321*a*, 321*b* (collectively 321), one or more first locking projections 322*a*, 322*b*, 322*c*, 322*d* (collectively 322), and inner protrusions 323*a*, 323*b* (collectively 323).

The arms 321 are configured to be elastically deformed. The arms 321 are spaced apart from each other with a first spacing d1 in some part and a second spacing d2 smaller than the first spacing d1 in some other part. Meanwhile, the present embodiment is illustrated as having two arms 321*a* and 321*b*, but the present disclosure is not so limited and may include three, four, or more arms. The one or more first locking projections 322 may be formed on all of the plurality of arms 321, respectively, to which the present disclosure is not limited, and the first locking projections 322 may be formed only on some of the plurality of arms 321. The following describes an embodiment having two arms 321*a* and 321*b* provided with the first locking projections 322, respectively.

The first locking projections 322 are each configured such that at least a portion thereof contacts the inner circumferential surface of the handle 20. One or more first locking projections 322 may be disposed along the outer circumferential surfaces of the plurality of arms 321. In this case, at least one pair of the first locking projections 322*a* and 322*d* may be symmetrically disposed with respect to one longitudinal section including the central axis of the handle 20. Accordingly, with the handle-engaging segment 300 inserted in the internal space of the handle 20, the pair of first locking projections 322 may provide a support force symmetrically with respect to one longitudinal section.

The inner protrusions 323 protrude radially inwardly from each end of the plurality of arms 321. This makes second gap d2 smaller than first gap d1 to be formed between the inner protrusions 323 of the plurality of arms 321. The inner protrusion 323 can prevent the plurality of arms 321 from being excessively bent inward. In other words, the inner protrusions 323 help to limit the minimum outer diameter of the first cantilever section 320. Meanwhile, the present embodiment is illustrated as having two inner protrusions 323*a* and 323*b*, although the present disclosure is not so limited, and the number and shape of the inner protrusions may be differently designed according to the number of the plurality of arms 321.

Figure 5:
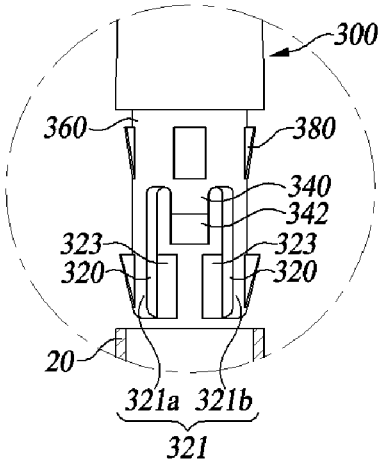
FIG. 5 illustrates sequential steps of a process of inserting the handle-engaging segment into a handle according to at least one embodiment of the present disclosure.
Figure 5:
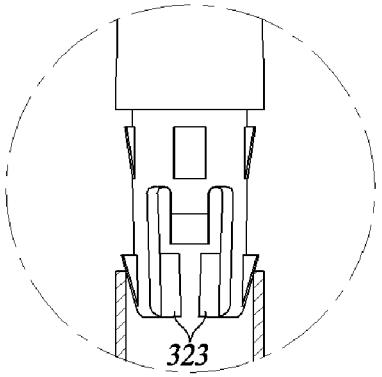
Figure 5:
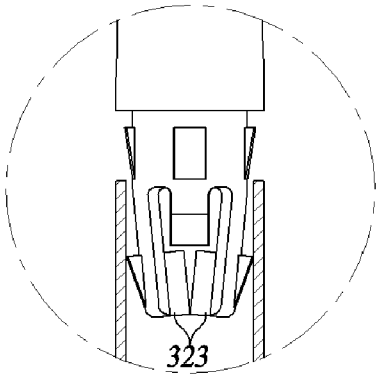

FIG. 5 illustrates sequential steps of a process of inserting the handle-engaging segment into the handle according to at least one embodiment of the present disclosure.

FIG. 5 shows at (a) the state just before the first cantilever section 320 is inserted into the handle 20. As shown in FIG. 5(*a*), the maximum diameter of the first cantilever section 320 including the first locking protrusions 322 may be larger than the inner diameter of the handle 20 so that the handle-engaging segment 300 can be forcibly fitted in the handle 20.

FIG. 5 shows at (b) an initial state of the first cantilever section 320 being inserted. As shown in FIG. 5(*b*), the first locking projections 322 has their surfaces so inclined that they decrease in height along the insertion direction of the handle-engaging segment 300. Accordingly, when inserted into the internal space of the handle 20, the handle-engaging segment 300 may be guided therein by the inclined surfaces of the first locking projections 322.

FIG. 5 shows at (c) the latter state of the first cantilever section 320 being inserted into the internal space of the handle 20. As shown in FIG. 5(*c*), the inner circumferential surface of the handle 20 is pressed under the restoring force acting thereon due to the elastic deformation of the plurality of arms 321 formed with the first locking projections 322, resulting in a friction force generated between the inner circumferential surface of the handle 20 and the first locking projections 322. Therefore, the handle-engaging segment 300 becomes immovable in the longitudinal direction of the handle 20 and can be stably fixed inside thereof.

The inner protrusions 323 included in the plurality of arms 321 protrude from at least some portion thereof in a direction in which the arms 321 are elastically deformed. When the handle-engaging segment 300 is inserted into the internal space of the handle 20, the plurality of inner protrusions 323 contact each other at least partially. This will limit elastic deformation or contraction of the arms of the first cantilever section 320. Therefore, the first inner protrusions 323, which come into contact with each other at least partially, stop further reduction of the minimum outer diameter of the cantilever 320, thereby limiting the minimum outer diameter. Further, the plurality of inner protrusions 323, which are in contact with each other and under pressure, provide a stronger hold against the contraction of the first cantilever section 320 compared to the absence of the plurality of inner protrusions 323. This can enhance the fastening force between the first cantilever section 320 and the handle 20.

FIG. 6 illustrates sequential steps of the process of inserting the handle-engaging segment into the handle according to at least one embodiment of the present disclosure.

FIG. 6 shows at (a) the second cantilever section 340 as partially inserted into the internal space of the handle 20. FIG. 6(*a*) illustrates the second cantilever section 340 including the one or more second locking projections 342. The second locking projection 342 is configured to at least partially contact the inner circumferential surface of the internal space of the handle 20. Meanwhile, the maximum diameter of the second cantilever section 340 may be larger than the inner diameter of the handle 20 by the protrusion of the second locking projection 342.

The second locking projection 342 has a surface so inclined that it decreases in height toward the insertion direction of the handle-engaging segment 300. Accordingly, when inserted into the internal space of the handle 20, the handle-engaging segment 300 may be guided therein by the inclined surface of the second locking projection 342.

FIG. 6 shows at (b) the second cantilever section 340 as fully inserted in the internal space of the handle 20. As shown in FIG. 6(*b*), the inner circumferential surface of internal space of the handle 20 is pressed in a direction in which a restoring force is exerted due to elastic deformation of the second cantilever section 340 formed with the second locking projection 342. Accordingly, a frictional force is generated between the inner circumferential surface of the internal space of the handle 20 and the second locking projection 342. This causes the handle-engaging segment 300 to be firmly secured inside the handle 20.

Alternatively, as with the second locking projection 342, the first locking projection 322 may be formed to be symmetrical to each other with respect to a cross section including the central axis of the handle 20. In this case, the second locking projection 342 and a pair of first locking projections 322 exert a restoring force in opposite directions on the inner circumferential surface of the handle 20. For example, the pair of first locking projections 322 may exert its restoring force upward and the second locking projection 342 may exert its restoring force downward. Further, the points of action of the respective locking projections are distributed with a longitudinal spacing on the handle 20. This provides a strong fastening force to the razor 1 so that it does not jolt during a stroke.

On the other hand, an experiment was conducted to measure the integration or fastening force of the razor 1 according to at least one embodiment of the present disclosure. Measurement was conducted on the maximum force required for separation of the handle 20 and the head unit 30 after they were intercoupled. The average fastening force according to the experiment was measured to be approximately 1,015 g·f. At this time, the fastening force may be approximately 830 g·f to 1,480 g·f, preferably 860 g·f to 1,170 g·f.

Considering that the average force applied to a typical portable razor during a stroke is about 43 g·f, it can be seen that the razor according to the present disclosure provides about 23 times more fastening force. Therefore, during a stroke using the razor 1 according to at least one embodiment of the present disclosure, the razor cartridge 10 does not break away from the handle or swing.

Figure 7:
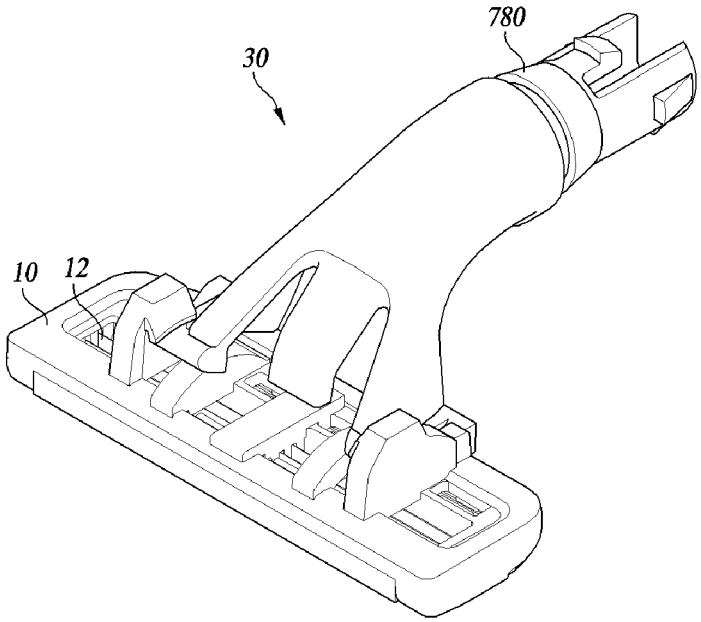
FIG. 7 is a perspective view of a razor according to another embodiment of the present disclosure.

FIG. 7 is a perspective view of a razor according to another embodiment of the present disclosure.

As shown in the configuration of FIG. 3, the third locking projections 380 may be composed of a plurality of discontinuous protrusions. Here, once the head unit 30 is inserted into the internal space of the handle 20, the third locking projections 380 adjacent to each other may have an interspace for allowing shaving foam, water, and various contaminants to be easily introduced into the interior of the handle 20. Since the handle 20 is made of an eco-friendly material, it is vulnerable to decomposition when exposed to water or moisture.

In another embodiment of FIG. 7, as a comparable structure to the aforementioned embodiment of the present disclosure, a third locking projection 780 may be provided with a continuous shape rather than a plurality of discontinuous arrangements. For example, the third locking projection 780 may be configured in the shape of a truncated cone that surrounds at least a portion of the outer circumferential surface of the support 360. Accordingly, the third locking projection 780 may seal at least one vertical section of the handle 20 along the longitudinal direction. Thanks to this configuration, there is an effect of preventing the inflow of water or foreign substances into the internal space of the handle 20.

The third locking projection 780 has an inclined surface configured to decrease in height in the insertion direction of the handle-engaging segment 300. Therefore, when inserted into the internal space of the handle 20, the handle-engaging segment 300 can be guided and inserted by the inclined surface of the third locking projection 780.

Figure 8:
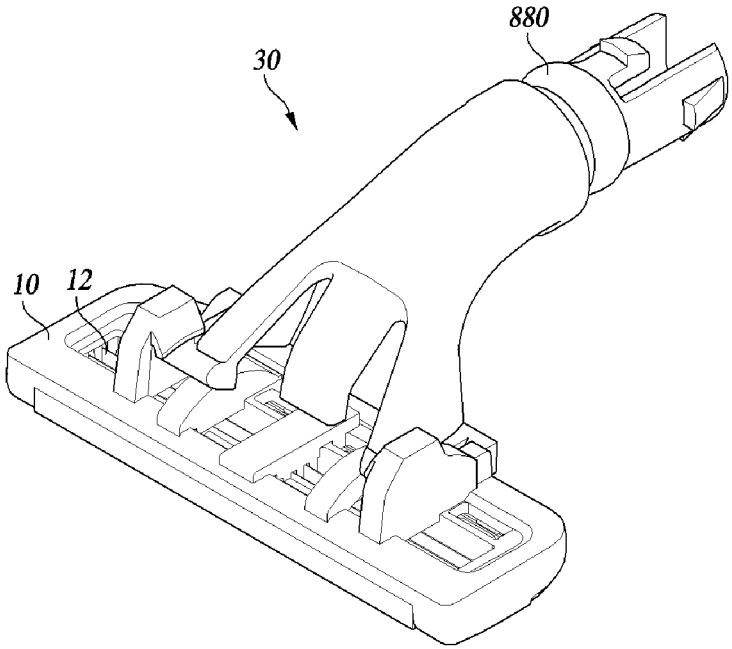
FIG. 8 is a perspective view of a razor according to yet another embodiment of the present disclosure.

FIG. 8 is a perspective view of a razor according to yet another embodiment of the present disclosure.

In yet another embodiment of FIG. 8, a third locking projection 880 may be provided with an O-ring shaped configuration. The O-ring may be formed by being integrally injected with the handle-engaging segment 300. However, the present disclosure is not limited thereto, and the third locking projection 880 may be a separately fastened rubber ring or a co-injected rubber ring.

The third locking projection 880 in the form of an O-ring can effectively prevent the shaving foam, water, etc. from flowing into the interior of the handle 20. In this case, the handle 20 may further include, on its inner circumferential surface, a groove (not shown) for receiving the O-ring third locking projection 880.

Although exemplary embodiments of the present disclosure have been described for illustrative purposes, those skilled in the art will appreciate that various modifications, additions, and substitutions are possible, without departing from the idea and scope of the claimed invention. Therefore, exemplary embodiments of the present disclosure have been described for the sake of brevity and clarity. The scope of the technical idea of the present embodiments is not limited by the illustrations. Accordingly, one of ordinary skill would understand the scope of the claimed invention is not to be limited by the above explicitly described embodiments but by the claims and equivalents thereof.

What is claimed is:

1. A razor, comprising:

a razor cartridge including at least one shaving blade;

a handle having an internal space; and a head unit, wherein the head unit comprises:

a cartridge-engaging segment configured to be coupled to the razor cartridge; and a handle-engaging segment having at least a portion configured to be inserted into the internal space of the handle and including a first cantilever section, and wherein the first cantilever section is configured:

to be inserted into the internal space by contacting at least a portion of an inner circumferential surface of the internal space; and to be at least partially elastically deformable such that a diameter of the first cantilever section along a length of the first cantilever section decreases toward a free end of the first cantilever section contacting the inner circumferential surface initially and being squeezed toward a longitudinal central axis of the handle-engaging segment when the first cantilever section is inserted into the internal space.

2. The razor of claim 1, wherein the first cantilever section comprises:

multiple arms arranged symmetrically with respect to the longitudinal central axis of the handle-engaging segment.

3. The razor of claim 2, wherein:

the multiple arms are disposed at a first distance from each other;

the first cantilever section further comprises multiple inner protrusions protruding inwardly of the multiple arms so as to be disposed at a second distance from each other;

the second distance is smaller than the first distance; and the multiple inner protrusions are configured to at least partially contact each other when the first cantilever section is inserted into the internal space of the handle.

4. The razor of claim 1, wherein the first cantilever section comprises at least one first locking projection configured to have at least a portion to be in contact with the inner circumferential surface of the internal space and configured to decrease in height toward the free end of the first cantilever section.

5. The razor of claim 1, wherein the handle-engaging segment further includes:

a second cantilever section configured to have at least a portion to be inserted into the internal space by contacting the inner circumferential surface of the internal space and having an outer diameter decreasing toward the free end of the first cantilever section.

6. The razor of claim 5, wherein the second cantilever section is different in length from the first cantilever section.

7. The razor of claim 5, wherein the second cantilever section includes at least one locking projection configured to have at least a portion to be in contact with the inner circumferential surface of the internal space and configured to decrease in height toward the free end of the first cantilever section.

8. The razor of claim 7, wherein:

the first cantilever section includes at least one first locking projection configured to have at least a portion to be in contact with the inner circumferential surface of the internal space and configured to decrease in height toward the free end of the first cantilever section; and one or more of the at least one locking projection of the first cantilever section protrudes symmetrically with respect to the longitudinal central axis of the handle-engaging segment.

9. The razor of claim 5, wherein the second cantilever section is configured to provide a reaction force against a direction in which the razor cartridge is urged upon stroking with the razor.

10. The razor of claim 1, wherein:

the handle-engaging segment further includes a support disposed between the razor cartridge and the first cantilever section; and the support has an outer circumferential surface provided with at least one locking protrusion configured to have at least a portion to be in contact with the inner circumferential surface of the internal space.

11. The razor of claim 10, wherein the at least one locking protrusion is configured to decrease in height toward the free end of the first cantilever section.

12. The razor of claim 10, wherein the at least one locking protrusion comprises a plurality of locking protrusions that are equidistantly disposed along the outer circumferential surface of the support.

13. The razor of claim 10, wherein the at least one locking protrusion is configured to continuously surround at least a portion of the outer circumferential surface of the support.

14. The razor of claim 10, wherein the at least one locking protrusion comprises an O-ring.

15. A razor comprising:

a handle having an internal space;

a razor cartridge; and a head unit, wherein the head unit comprises:

a cartridge-engaging segment configured to be coupled to the razor cartridge; and a handle-engaging segment to be inserted into the internal space of the handle, and wherein the handle-engaging segment comprises:

at least one first locking projection configured to be in contact with at least a portion of an inner circumferential surface of the internal space; and at least one second locking projection disposed between the razor cartridge and the at least one first locking projection and configured to be in contact with the inner circumferential surface of the internal space, and wherein each of the at least one first locking projection and the at least one second locking projection has an inclined surface configured to decrease in height along an insertion direction of the handle-engaging segment.

16. The razor of claim 15, further comprising:

at least one third locking projection disposed between the razor cartridge and the at least one second locking projection and configured to be in contact with the inner circumferential surface of the internal space.

17. The razor of claim 16, wherein the at least one third locking projection has an inclined surface configured to decrease in height along the insertion direction of the handle-engaging segment.

* * * * *